US010024008B2

(12) United States Patent
Holmer et al.

(10) Patent No.: US 10,024,008 B2
(45) Date of Patent: Jul. 17, 2018

(54) EXPEDIENT BARRIER APPARATUS

(71) Applicant: The United States of America as Represented by The Secretary of The Army, Washington, DC (US)

(72) Inventors: Matthew S. Holmer, Clinton, MS (US); James C. Ray, Clinton, MS (US); Bradford A. Steed, Vicksburg, MS (US); Bradley W. Foust, Madison, MS (US); Micael C. Edwards, Vicksburg, MS (US); Christopher G. Price, Vicksburg, MS (US); Tyler S. Oesch, Berlin (DE); Daniel W. Wilkes, Jr., Vicksburg, MS (US); Keith A. Flournoy, Vicksburg, MS (US); Gordon W. McMahon, Vicksburg, MS (US); Bartley P. Durst, Clinton, MS (US)

(73) Assignee: The United States of America as Represented by The Secretary of The Army, Alexandria, VA (US)

( * ) Notice: Subject to any disclaimer, the term of this patent is extended or adjusted under 35 U.S.C. 154(b) by 0 days.

(21) Appl. No.: 15/135,312

(22) Filed: Apr. 21, 2016

(65) Prior Publication Data

US 2017/0130410 A1 May 11, 2017

Related U.S. Application Data

(60) Provisional application No. 62/253,587, filed on Nov. 10, 2015.

(51) Int. Cl.
*E01F 13/12* (2006.01)
*E01F 13/02* (2006.01)
*E01F 15/00* (2006.01)

(52) U.S. Cl.
CPC ..... *E01F 13/12* (2013.01); *E01F 13/02* (2013.01); *E01F 13/123* (2013.01); *E01F 15/00* (2013.01)

(58) Field of Classification Search
CPC ..... E01F 13/12; E01F 13/02; E01F 13/123; E01F 9/0122; E01F 9/012; E01F 9/0175; E01F 15/148; E01F 15/10; E01F 15/12
See application file for complete search history.

(56) References Cited

U.S. PATENT DOCUMENTS 4,490,069 A * 12/1984 Cushman ..... E01F 9/529 404/15
4,828,424 A * 5/1989 Crisp, Sr. ..... E01F 13/123 404/6
5,549,410 A * 8/1996 Beryozkin ..... E01F 13/12 404/6

(Continued)

*Primary Examiner* — Abigail A Risic
(74) *Attorney, Agent, or Firm* — Brian C. Jones

(57) ABSTRACT

A vehicle barrier apparatus includes a horizontal barrier component, a vertical barrier component, at least one rigid stabilizer beam having two end surfaces and at least one elongated side surface. One end of the stabilizer beam is affixed to the vertical barrier component. The elongated side surface of the stabilizer beam is affixed to the horizontal barrier component to prevent rotational movement of the vertical barrier component. A lower surface of the horizontal barrier component is a friction-enhanced surface which creates a sliding friction interface upon contact of a moving vehicle with the vertical barrier component.

16 Claims, 4 Drawing Sheets

(56) References Cited

U.S. PATENT DOCUMENTS

Figure 1A:
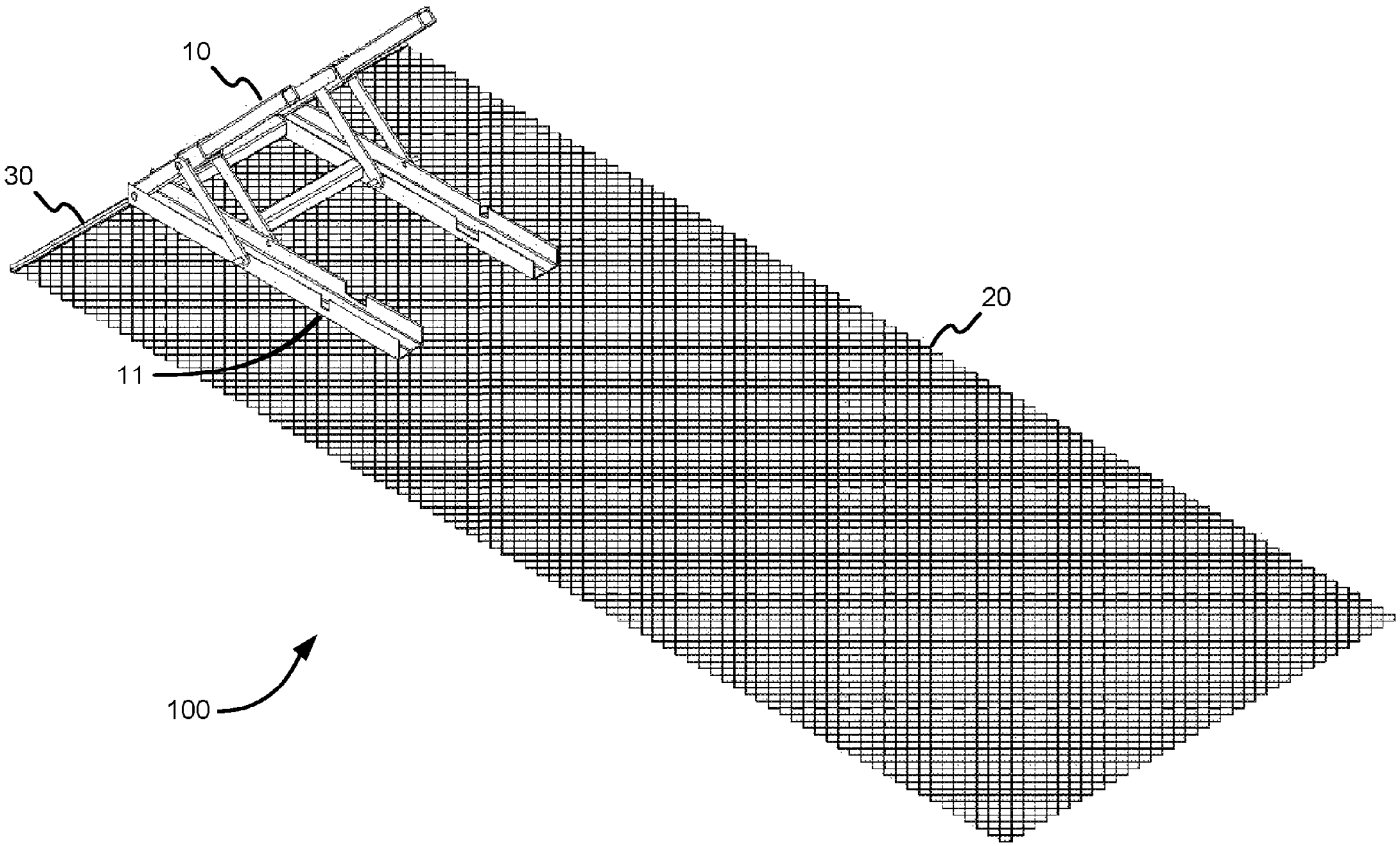

| | | | | |
|---|---|---|---|---|
| 6,206,608 | B1 * | 3/2001 | Blevins | E01F 13/12 404/6 |
| 6,220,781 | B1 * | 4/2001 | Miller | E01F 13/12 404/6 |
| 6,409,420 | B1 * | 6/2002 | Horton | E01F 13/123 404/6 |
| 7,736,086 | B2 * | 6/2010 | Coomber | E01F 13/12 404/6 |
| 8,469,627 | B2 * | 6/2013 | Castro | E01F 13/12 404/6 |
| 2006/0140715 | A1 * | 6/2006 | Lyddon | E01F 13/12 404/6 |
| 2008/0060271 | A1 * | 3/2008 | Beniamin | E01F 13/12 49/34 |
| 2009/0263190 | A1 * | 10/2009 | Segal | E01F 13/12 404/6 |
| 2009/0317185 | A1 * | 12/2009 | Coomber | E01F 13/12 404/6 |
| 2012/0177439 | A1 * | 7/2012 | More | E01F 13/12 404/6 |
| 2014/0301781 | A1 * | 10/2014 | Lindberg | E01F 15/146 404/6 |

* cited by examiner

EXPEDIENT BARRIER APPARATUS

CROSS-REFERENCE TO RELATED APPLICATIONS

This patent application claims the benefit of U.S. Provisional Application No. 62/253,587 filed Nov. 10, 2015. The above application is incorporated by reference herein.

STATEMENT REGARDING FEDERALLY SPONSORED RESEARCH OR DEVELOPMENT

The invention described herein was made by an employee of the United States Government and nay be manufactured and used by the Government of the United States of America for governmental purposes without the payment of any royalties thereon or therefore.

BACKGROUND OF THE INVENTION

1. Field of Invention

This invention relates to the field of rapidly deployable traffic barriers (referred to as "expedient barriers") which bring vehicles to a controlled stop by interfering with tire rolling.

2. Description of Related Art

Vehicle checkpoints, roadblocks and barriers (i.e., "barriers" generally) manned by military personnel and/or law enforcement are becoming increasingly commonplace in the world we live in. There are several objectives of the barriers. To the greatest extent possible, the personnel who are operating the barriers must be protected from threats, typically associated with the vehicles and occupants the barriers are designed to stop. Of course, barriers usually serve to protect personnel and facilities within an established perimeter or region.

Often, in a crisis, expedient barriers must be rapidly deployed. As a result, vehicles containing peaceful civilians or other local police or military personnel may unexpectedly encounter an expedient barrier where none previously existed, be caught by surprise and fail to appropriately slow down.

The US military has consistently sought solutions for rapid deployment of vehicle barriers. The US Army Corps of Engineers, Naval Facilities Engineering Command, the US Air Force and the State Department have conducted research to design effective barrier devices, without regard to the use of other physical mechanisms to prevent a vehicle from breaching a checkpoint. Research has primarily focused on the development of barricade structures.

U.S. Patent Application No. 2014/0301781 to Lindberg et al proposed the use of both a ground barrier and upright vertical barrier to slow an approaching vehicle. Lindberg utilized a rebar ground barrier capable of supporting the weight of vehicles. This structure requires significant cargo space to accommodate its shape, and requires several persons to deploy it on site. Once in place, it is difficult to move or reconfigure the structure.

There is an unmet need for rapidly deployable and easily stored equipment at checkpoints which can safely and reliably stop a speeding vehicle at a checkpoint.

There is a further unmet need in the art for checkpoints with cuing mechanisms to reduce instances of miscommunications with drivers.

BRIEF SUMMARY OF THE INVENTION

A vehicle barrier apparatus includes a horizontal barrier component, a vertical barrier component, at least one rigid stabilizer beam having two end surfaces and at least one elongated side surface. One end of the stabilizer beam is affixed to the vertical barrier component. The elongated side surface of the stabilizer beam is affixed to the horizontal barrier component to prevent rotational movement of the vertical barrier component. A lower surface of the horizontal barrier component is a friction-enhanced surface which creates a sliding friction interface upon contact of a moving vehicle with the vertical barrier component.

BRIEF DESCRIPTION OF SEVERAL VIEWS OF THE DRAWING(S)

FIG. 1*a* illustrates a perspective view of an exemplary embodiment of a vehicle barrier apparatus.

Figure 1B:
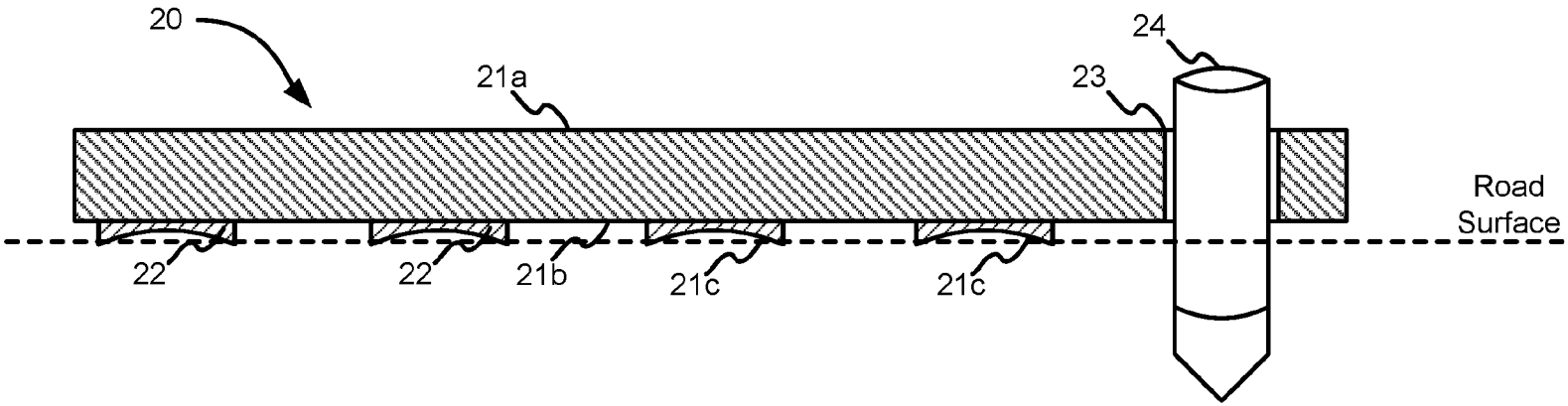

FIG. 1*b* is a sectional view of an embodiment of a horizontal barrier component.

Figure 1C:
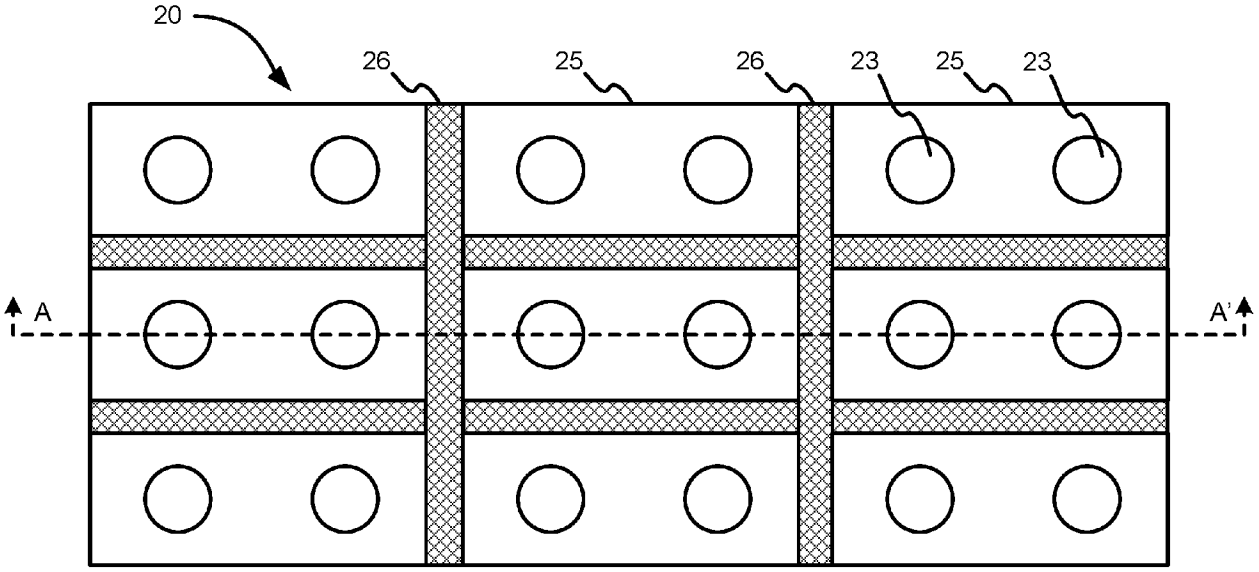
Figure 1D:
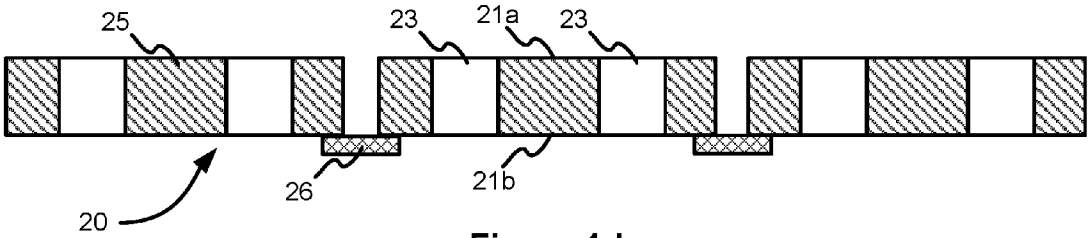

FIGS. 1*c* and 1*d* are top and sectional views, respectively of another embodiment of a horizontal barrier component.

Figure 1E:
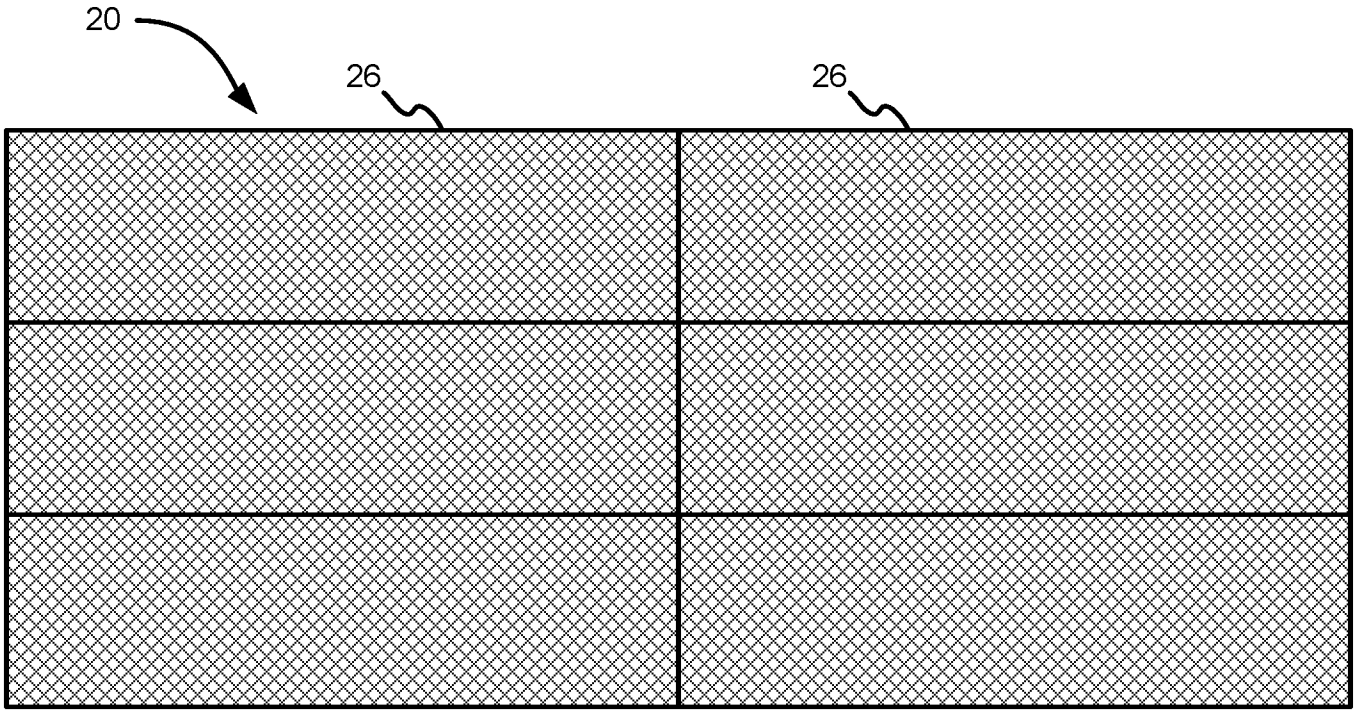

FIG. 1*e* is a top view of another embodiment of a horizontal barrier component.

DETAILED DESCRIPTION OF THE INVENTION

FIG. 1*a* illustrates a perspective view of an exemplary embodiment of vehicle barrier apparatus 100. FIG. 1*b* is a sectional view of an embodiment of horizontal barrier component 20. FIGS. 1*c* and 1*d* are top and sectional views, respectively of another embodiment of horizontal barrier component 20. FIG. 1*e* is a top view of another embodiment of horizontal barrier component 20.

Vehicle barrier apparatus 100 includes at least one vertical barrier component 10, at least one stabilizer beam 11, and at least one horizontal barrier component 20 connected to at least one optional spreader bar 30. Certain embodiments of vehicle barrier apparatus 100 include multiple vertical barrier components 10, multiple stabilizer beams 11, multiple horizontal barrier components 20 and/or multiple spreader bars 30.

Vertical barrier component 10 is a rigid component extending at least partially in a vertical direction relative to a road surface. Vertical barrier component 10 has a minimum vertical height equal to a height of a target vehicle bumper, allowing vertical barrier component 10 to come into contact with and restrict the target vehicle motion.

Stabilizer beam 11 has a length greater than a height of the target vehicle bumper, preventing vertical barrier component 10 from rotating when hit by the target vehicle. In certain embodiments, vertical barrier component 10 has a movable connection to stabilizer beam 11 to alter an angle between vertical barrier component 10 and stabilizer beam 11. In the exemplary embodiment, the movable connection is a hinged or pinned movable connection between vertical barrier component 10 and stabilizer beam 11. Vertical barrier component 10 forms an angle with stabilizer beam 11 ranging from approximately 15 degrees to approximately 90 degrees. In certain embodiments, springs, pneumatic or hydraulic cylinders, or other actuating components between vertical barrier component 10 and stabilizer beam 11 to allow rapid setup of vehicle barrier apparatus 100.

Horizontal barrier component 20 is a structure capable of preventing rolling of a vehicle tire relative to the road surface beneath the tire when placed between the vehicle time and the road surface. Horizontal barrier component 20 may be constructed of metal, fabric, nylon, other polymers, resins, carbon fiber, or composites thereof. Because horizontal barrier component 20 prevents contact between the target vehicle and a road surface, vehicle barrier apparatus 100 skids along the road surface under the target vehicle's momentum. In certain embodiments, a plurality of modular horizontal barrier components 20 connect together to accommodate larger sizes of vehicle barrier apparatus 100.

Horizontal barrier component 20 may be a rigid or flexible structure. A flexible structure is non-rigid and/or deformable, or comprised of components capable of being moved or repositioned without breakage. A flexible structure is one capable of being bent, flexed, twisted or folded to alter its shape or position and reduce the amount of space necessary for storage. Because a flexible horizontal barrier component 20 can be rolled or folded, it is easy to transport and maneuver into place. A rigid horizontal barrier component 20 can be easily manufactured from one or more sections of rigid material.

Horizontal barrier component 20 is affixed to stabilizer beam 11. Affixation is the connection of horizontal barrier component 20 to stabilizer beam 11 by means of cables, threaded and unthreaded connectors, male-female connecting structures, and any other connecting means known in the art. In certain embodiments, horizontal barrier component 20 is selectively affixed to stabilizer beam 11, allowing for replacement. In certain embodiments, horizontal barrier component 20 is permanently affixed to stabilizer beam 11. Horizontal barrier component 20 has a barrier length greater than a wheelbase of the target vehicle, and a barrier width greater than an axle track of the target vehicle.

In embodiments where horizontal barrier component 20 is flexible, horizontal barrier component 20 is also attached to spreader bar 30. Because horizontal barrier component 20 includes a tension force when attached to spreader bar 30, it is "under tension" and does not roll or otherwise contract during use. Spreader bar 30 keeps a flexible horizontal barrier component 20 from rolling up or otherwise deforming during use. In the exemplary embodiment, spreader bar 30 is integrated with vertical barrier component 10 and/or stabilizer beam 11. In other embodiments, spreader bar 30 is separate from vertical barrier component 10 and/or stabilizer beam 11.

In the embodiment shown in FIG. 1*b*, horizontal barrier component 20 includes an upper barrier surface 21*a* and a lower barrier surface 21*b* having a friction-enhanced surface 21*c*. Friction-enhanced surface 21*c* is a surface which increases friction between horizontal barrier component 20 and the road surface. Upon contact of a moving vehicle with vertical barrier component 10, friction-enhanced surface 21*c* creates a sliding friction interface, at least one physical point of sliding contact between friction-enhanced surface 21*c* and the road surface. Friction-enhanced surface 21*c* has a minimum coefficient of kinetic friction with a road surface of approximately 0.3. In certain embodiments, friction-enhanced surface 21*c* includes at least one frictional structure 22, which increases the coefficient of kinetic friction between the road surface and horizontal barrier component 20. Frictional structures 22 can include metal grating, at least one layer of elastomer, integral metal protrusions, welded metal angles or bolted metal angles.

In certain embodiments, horizontal barrier component 20 includes apertures 23 extending from upper barrier surface 21*a* to lower barrier surface 21*b*. Aperture 23 is a chamber, cavity or structural configuration which minimizes material and reduces weight. An average diameter of apertures 23 is inversely proportional to a road roughness surface coefficient $K_s$ calculated by the equation:

$$K_s = \frac{\sum_{i=1}^{i=n} (b_i - a)^2}{n}$$

wherein b is the height of a road surface at a measurement point i, a is the average height of the road surface and n is the total number of measurement points i.

In certain embodiments, at least one barrier anchor 24 may pass through aperture 23 into a road surface below. Barrier anchor 24 is a stake, picket, peg, or other anchor capable of fixing horizontal barrier component 20 to a road surface, increasing the force required to move horizontal barrier component 20. In certain embodiments, horizontal barrier component 20 also includes a vehicle disabling mechanism 40 on upper barrier surface 21*a*. Vehicle disabling mechanism 40 may include spike strips or other tire deflation devices, or a mechanism which prevents a target vehicle from disengaging from vehicle barrier apparatus 100.

In the embodiment shown in FIGS. 1*c* and 1*d*, horizontal barrier component 20 is made up of a plurality of flexible panel components 25 connected by link components 26. This allows horizontal barrier component 20 to be folded or rolled into a more compact configuration for easier storage, transport and placement. In certain embodiments, flexible panel components 25 are modular. In one embodiment, flexible panel components 25 are metallic panel components made from aluminum.

In certain embodiments, link components 26 are meshes of cargo netting riveted to flexible panel components 25. A mesh is a material made of woven or connected fibers, strands, wires, tapes, strips, fabric, metal, or other materials or other components which are structurally integrated, interwoven, crossed, twisted, interlocking, interconnected or otherwise structurally integrated or attached. In various embodiments, mesh may include apertures 23 or be configured to reduce weight or to increase structural integrity. Link components 26 may be manufactured from polymer straps having a tensile strength of at least 10,000 lbs. per strap. In other embodiments, link components 26 are a plurality of woven metal wires. The plurality of woven metal wires includes coated steel wires or chain link fencing. In still another embodiment, link components 26 are meshes of a para-aramid synthetic fiber. Link components 26 may have an asymmetrical or symmetrical configuration, and may have a sinuous or triangular waveform configuration.

In another embodiment shown in FIG. 1*e*, horizontal barrier component 20 is a mesh made solely from a plurality of interconnected link components 26, as discussed above.

It will be understood that many additional changes in the details, materials, procedures and arrangement of parts, which have been herein described and illustrated to explain the nature of the invention, may be made by those skilled in the art within the principle and scope of the invention as expressed in the appended claims. Moreover, the term "approximately" as used herein may be applied to modify any quantitative representation that could permissibly vary without resulting in a change in the basic function to which it is related.

It should be further understood that the drawings are not necessarily to scale; instead, emphasis has been placed upon illustrating the principles of the invention.

What is claimed is:

1. A vehicle barrier apparatus, comprising:

at least one vertical barrier component, wherein said at least one vertical barrier component is rigid;

at least one horizontal barrier component, wherein said at least one horizontal barrier component includes a lower barrier surface having a friction-enhanced surface, wherein said friction-enhanced surface creates a sliding friction interface upon contact of a moving target vehicle with said at least one vertical barrier component; wherein said horizontal barrier component prevents contact between the target vehicle and a road surface, and said vehicle barrier apparatus skids along the road surface under the target vehicle's momentum, wherein said at least one horizontal barrier component further includes a plurality of apertures extending therethrough; wherein an average diameter of said plurality of apertures is inversely proportional to a road roughness surface coefficient K calculated by the equation:

$$K_s = \frac{\sum_{i=1}^{i=n} (b_i - a)^2}{n}$$

wherein b is the height of a road surface at a measurement point i, a is the average height of the road surface and n is the total number of measurement points i;

at least one stabilizer beam having two end surfaces and at least one elongated side surface, wherein one end of said stabilizer beam is affixed to said at least one vertical barrier component, wherein said at least one elongated surface is affixed to said at least one horizontal barrier component to prevent rotational movement of said at least one vertical barrier component; and wherein said at least one horizontal barrier component is a flexible horizontal barrier component attached to at least one spreader bar.

2. The apparatus of claim 1, wherein said at least one vertical barrier component has a minimum vertical height equal to a target vehicle bumper.

3. The apparatus of claim 1, wherein said at least one vertical barrier component and said at least one stabilizer beam are movably attached to alter an angle between said at least one vertical barrier component and said at least one stabilizer beam.

4. The apparatus of claim 3, further including an actuating component connected to said at least one vertical barrier component and said at least one stabilizer beam, wherein said actuating component is selected from the group consisting of: springs, pneumatic cylinders, and hydraulic cylinders.

5. The apparatus of claim 1, wherein said at least one vertical barrier component forms an angle with said at least one stabilizer beam ranging from approximately 15 degrees to approximately 90 degrees.

6. The apparatus of claim 1, wherein said at least one stabilizing beam is permanently affixed to said at least one horizontal barrier component.

7. The apparatus of claim 1, wherein said at least one stabilizing beam is selectively affixed to said at least one horizontal barrier component.

8. The apparatus of claim 1, wherein said friction-enhanced surface has a minimum coefficient of kinetic friction with a road surface of approximately 0.3.

9. The apparatus of claim 1, wherein said friction-enhanced surface comprises at least one frictional structure selected from the group consisting of: metal grating, at least one layer of elastomer, integral metal protrusions, welded metal angles and bolted metal angles.

10. The apparatus of claim 1, wherein at least one of said plurality of apertures includes a barrier anchor extending through said at least one of said plurality of apertures and into a road surface.

11. The apparatus of claim 1, wherein said at least one horizontal barrier component is at least one section of rigid material.

12. The apparatus of claim 1, wherein said at least one horizontal barrier component is a plurality of flexible panel components interconnected by a plurality of link components.

13. The apparatus of claim 12, wherein said plurality of flexible panel components are a plurality of metallic panel components.

14. The apparatus of claim 12, wherein said plurality of link components are selected from the group consisting of: a plurality of polymer straps having a tensile strength of at least 10,000 lbs. and a plurality of interconnected woven metal wires.

15. The apparatus of claim 11, wherein said at least one horizontal barrier component is comprised of a plurality of interconnected link components.

16. The apparatus of claim 15, wherein said plurality of interconnected link components are selected from the group consisting of: a plurality of interconnected polymer straps having a tensile strength of at least 10,000 lbs., a plurality of interconnected woven metal wires, and interconnected para-aramid synthetic fibers.

* * * * *